US009717643B2

(12) United States Patent
Guang

(10) Patent No.: US 9,717,643 B2
(45) Date of Patent: Aug. 1, 2017

(54) VIBRATOR

(71) Applicant: JOPEN LLC, Chino, CA (US)

(72) Inventor: Fan Guang, Dongguan (CN)

(73) Assignee: Jopen LLC, Chino, CA (US)

( * ) Notice: Subject to any disclaimer, the term of this patent is extended or adjusted under 35 U.S.C. 154(b) by 500 days.

(21) Appl. No.: 14/141,841

(22) Filed: Dec. 27, 2013

(65) Prior Publication Data

US 2015/0182413 A1 Jul. 2, 2015

(51) Int. Cl.
*A61H 19/00* (2006.01)
*A61H 23/02* (2006.01)

(52) U.S. Cl.
CPC ..... *A61H 19/34* (2013.01); *A61H 19/44* (2013.01); *A61H 23/0263* (2013.01)

(58) Field of Classification Search
CPC ..... A61H 19/00; A61H 19/30; A61H 19/34; A61H 19/40; A61H 19/44; A61H 19/50; A61H 21/00; A61H 2205/085; A61H 2205/087
USPC ..... 600/38; 601/DIG. 16
See application file for complete search history.

(56) References Cited

U.S. PATENT DOCUMENTS

D270,279 S 8/1983 Hamilton
D272,090 S 1/1984 Hosid
D338,964 S 8/1993 Tarjoto
D484,608 S 12/2003 Tinsley
D681,222 S 4/2013 Chen
D687,957 S 8/2013 Heskier
2004/0230093 A1* 11/2004 Marshall ..... A61H 19/34 600/38
2006/0141903 A1* 6/2006 Gardos ..... A61H 19/34 446/490
2008/0009775 A1* 1/2008 Murison ..... A61H 19/34 601/46
2013/0296645 A1* 11/2013 Evans ..... A61H 19/50 600/41
2015/0164738 A1* 6/2015 Caropelo ..... A61H 23/02 601/46

* cited by examiner

*Primary Examiner* — Justine Yu
*Assistant Examiner* — Michael Tsai
(74) *Attorney, Agent, or Firm* — Walter W. Duft

(57) ABSTRACT

A vibrator for delivering distributed vibrations over a diffuse area of a human body. The vibrator includes a vibration head operable to deliver vibrations to a first region of the body, and one or more flexible elements disposed on one or more sides of the vibration head. The one or more flexible elements are operable to deliver vibrations to one or more additional body areas on one or more sides of the first body region. The one or more flexible elements are sufficiently compliant to conform to a contour of the one or more additional areas and lie in substantially contacting engagement against surfaces thereof along substantially the entire length of each flexible element.

16 Claims, 4 Drawing Sheets

VIBRATOR

BACKGROUND

1. Field

The present disclosure relates to massage apparatus, and in particular, to vibrators.

2. Description of the Prior Art

By way of background, there are many shapes and sizes of vibrators for massaging/stimulating various areas of the human anatomy. Typically, such devices have a base adapted to be held by a user and a vibration head containing a vibration motor that is adapted to deliver vibrations to a specific area of the body. Variations on this basic design include the addition of a secondary vibration head that is closer to the base of the vibrator for simultaneously stimulating two specific areas of the body that are spaced from each other. It is to improvements in the field of vibrators that the present disclosure is directed. In particular, the present disclosure is directed to a vibrator that is capable of distributing vibrations over a diffuse area of the body.

SUMMARY

A vibrator is provided for delivering distributed vibrations over a diffuse area of a human body. In one aspect, the vibrator includes a vibration head that is operable to deliver vibrations to a first region of the body. The vibrator further includes one or more flexible elements disposed on one or more sides of the vibration head. The one or more flexible elements are operable to deliver vibrations to one or more additional body areas on one or more sides of the first body region. The one or more flexible elements are sufficiently compliant to conform to a contour of the one or more additional areas and lie in substantially contacting engagement against surfaces thereof along substantially the entire length of each flexible element. The vibrator is thereby operable to deliver distributed vibrations over a diffuse area of the human body that includes the first body region and the one or more additional areas.

In an example embodiment, the one or more flexible elements comprise a pair of flexible elements in the form of flaps disposed on opposite sides of the vibration head, the flaps being operable to deliver vibrations to two additional areas on two sides of the first body region.

In an example embodiment, the one or more flexible elements are part of a rubber sheath that covers the vibration head.

In an example embodiment, the one or more flexible elements are anchored at a base end of the vibration head.

In an example embodiment, the one or more flexible elements are bendable between a closed home position wherein the one or more flexible elements are adjacent to the vibration head, and an open spread position wherein the one or more flexible elements are displaced away from the vibration head.

In an example embodiment, the one or more flexible elements extend beyond a free end of the vibration head when in the home position.

In an example embodiment, the one or more flexible elements are spaced from the vibration head when in the home position.

In an example embodiment, the one or more flexible elements are flexible enough to bend approximately 90-180 degrees from the home position to the spread position.

In an example embodiment, the one or more flexible elements comprise flaps that each have a thickness dimension and a width dimension, the thickness dimension being substantially smaller than the width dimension in order to render the one or more flexible elements substantially bendable.

In an example embodiment, the width dimension that is at least approximately eight times the thickness dimension.

In another aspect, the vibrator includes a vibration head operable to deliver vibrations to a first region of the human body, and a pair of flexible flaps disposed on opposite sides of the vibration head. The flaps are operable to deliver vibrations to two additional areas on both sides of the first body region. The flaps are sufficiently compliant to conform to a contour of the two additional areas and lie in substantially contacting engagement against surfaces thereof along substantially the entire length of each flexible element. The vibrator is thereby operable to deliver distributed vibrations over a diffuse area of the human body that includes the first body region and the two additional areas.

In an example embodiment, the vibrator further includes a base attached to a base end of the vibration head. The base and the vibration head define an elongated vibrator body in which the base and the vibration head respectively provide first and second vibrator body end portions. A vibration motor is disposed in the vibrator body. The vibration motor is operable to impart vibrations to the vibration head, and to the flexible elements.

In another aspect, a method for delivering distributed vibrations over a diffuse area of a human body is disclosed. According to the method, a vibrator comprising a vibration head and one or more flexible elements is provided. The vibration head is operable to deliver vibrations to a first region of the human body. The one or more flexible elements are disposed on one or more sides of the vibration head. The one or more flexible elements are operable to deliver vibrations to one or more additional areas on one or more sides of the first body region. The one or more flexible elements are sufficiently compliant to conform to a contour of the one or more additional areas and lie in substantially contacting engagement against surfaces thereof along substantially the entire length of each flexible element. The vibrator is thereby operable to deliver distributed vibrations over a diffuse area of the human body that includes the first body region and the one or more additional areas. The method comprises inserting the vibration head into an orifice representing the first body region, and contacting the one or more flexible elements against the one or more additional areas of the human body. The vibration head is then advanced into the orifice to spread the one or more flexible elements due to the increasing surface contact that occurs between the one or more flexible elements and the one or more additional areas of the human body.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
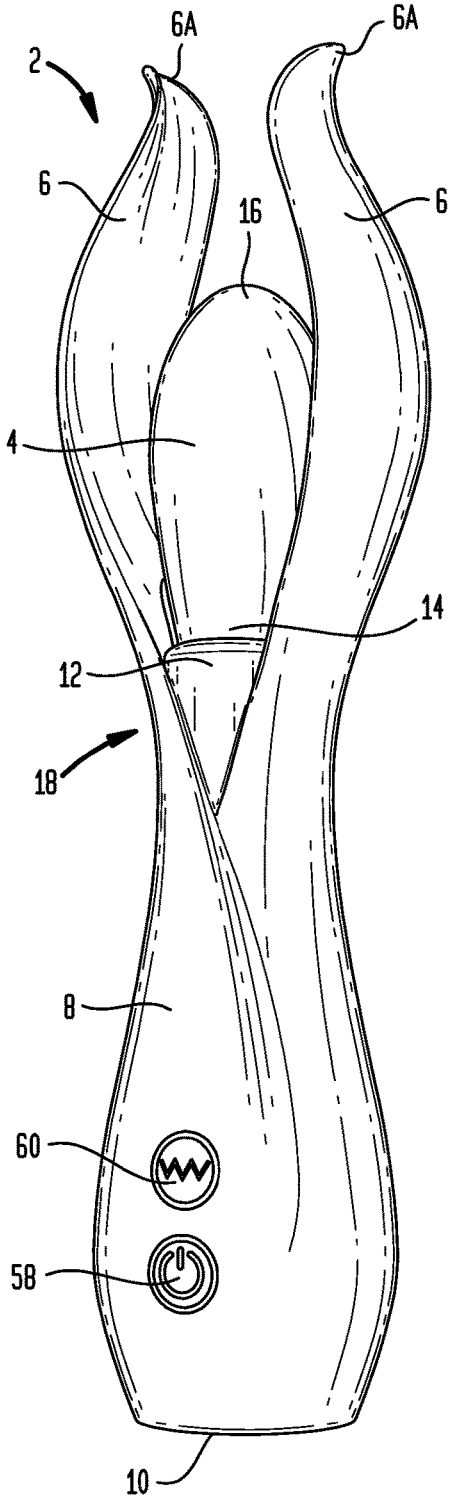
FIG. 1 is a front perspective view showing an example vibrator embodiment.

Turning now to FIGS. 1-5, an example embodiment of a vibrator 2 includes a vibration head 4 operable to deliver vibrations to a first or primary region of a human body. The vibrator 2 further includes one or more flexible elements 6 (two are shown) disposed on one or more sides of the vibration head 4. In the illustrated embodiment, the vibrator 2 additionally includes a base 8 having a base end 10 and a head end 12. The head end 12 of the base 8 is attached to a base end 14 of the vibration head 4. The vibration head 4 also has a free end 16. The base 8 and the vibration head 4 collectively define an elongated vibrator body 18 in which the base and the vibration head respectively provide first and second vibrator body end portions. In other embodiments, the base 8 might be substantially shorter, or may not be distinguishable at all from the vibration head 4.

Figure 5:
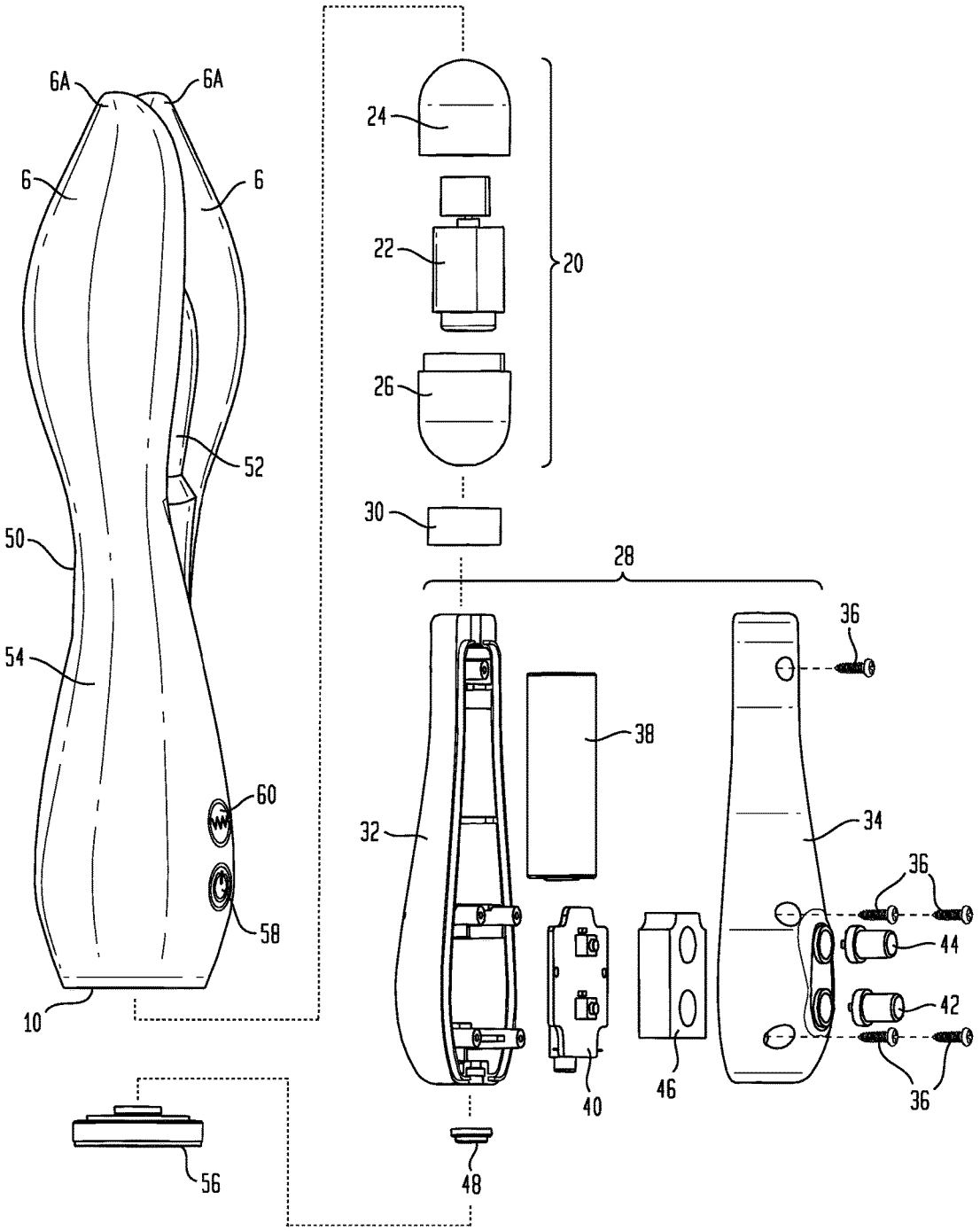
FIG. 5 is an exploded perspective view showing internal components of the example vibrator embodiment of FIG. 1.

As shown in FIG. 5, the vibrator 2 may further include various internal vibration-generating components and control components disposed inside the vibrator body 18. The vibration generating components may include a vibration bullet 20 housing a vibration motor 22 within a bullet top cover 24 and a bullet bottom cover 26. The control components may be provided by a control unit 28 that may (if desired) be isolated from the vibration bullet by a foam spacer 30. The control unit 28 may include a control unit housing formed by a base section 32 and a top cover section 34. The base and cover sections 32/34 may be attached to each other using screws 36 or other suitable fasteners. The control unit 28 may further include a battery power source 38, and a printed circuit control board 40 for controlling the vibration motor 22. Respective power and mode control buttons 42 and 44 may be provided in the top cover section 34, allowing a user to respectively control power to the vibration motor 22 and its mode of operation. A foam spacer 46 may be provided to protect the electronic components located on top of the control board 40. A battery recharging receptacle 48 may be provided at the bottom of the control housing base section 32 so that the battery 38 can be recharged.

In the illustrated embodiment, the vibrator body 18, including the vibration head 4 and the base 8, comprises a flexible cover sheath 50, made from silicone rubber or the like, having a vibration head-covering portion 52 and base-covering portion 54. The sheath 50 covers the vibrator's internal vibration-generating components and control components, which are themselves rigid structures that cause the vibrator body 18, as a whole, to be a rigid structure. In order to facilitate placement of these components within the vibrator body 18, the base 8 may be formed with an opening (not shown) at its base end 10 that is accessible via a removable cover 56 that is also formed of flexible rubber. The cover 56 may be conveniently formed with a central thinned area that aligns with the recharging receptacle 48, such that the cover can be pierced by a recharging plug (not shown) in order to deliver a battery charging current to the receptacle. As can be seen in FIGS. 1 and 5, the cover sheath 50 may be provided with defined control button indicators 58 and 60 that respectively cover the power button 42 and the mode control button 44.

Figure 2:
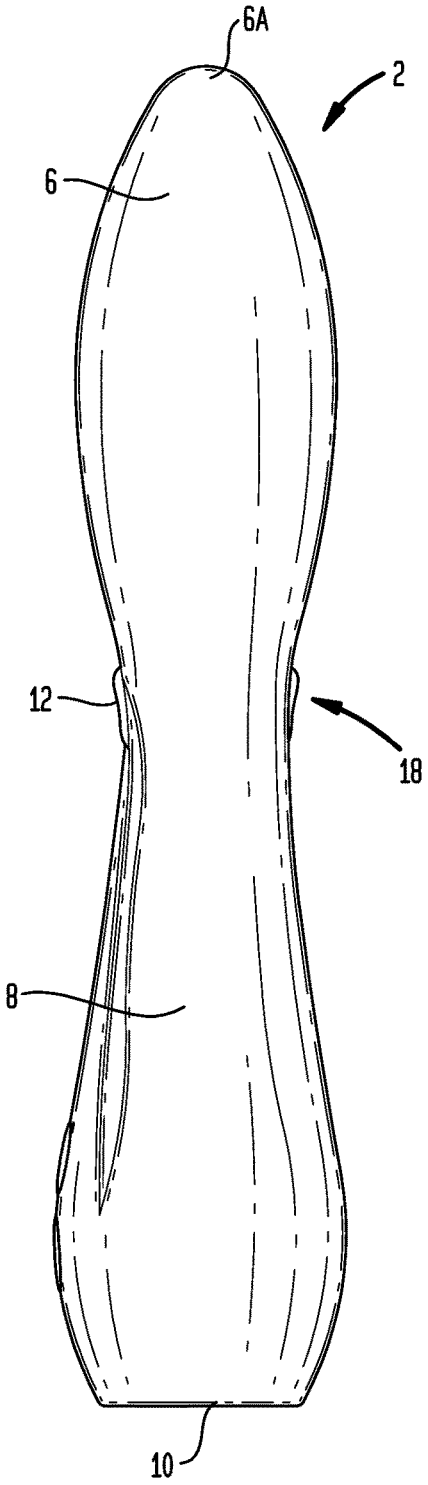
FIG. 2 is a rear elevation view of the example vibrator embodiment of FIG. 1.
Figure 3:
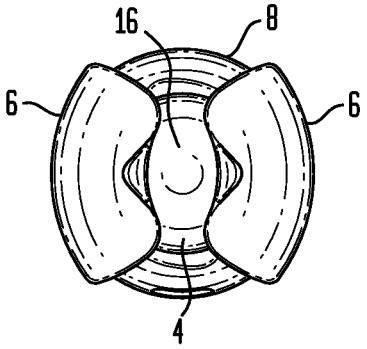
FIG. 3 is a top plan view of the example vibrator embodiment of FIG. 1.
Figure 4:
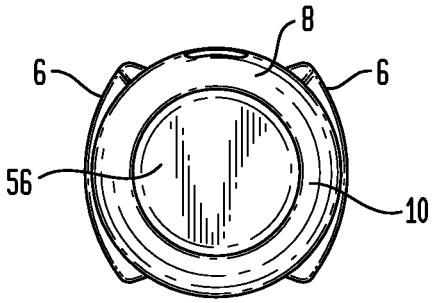
FIG. 4 is a bottom plan view of the example vibrator embodiment of FIG. 1.

In the illustrated embodiment, the cover sheath 52 also forms the one or more flexible elements 6. The number of flexible elements 6 used in the vibrator 2 is a matter of design choice. The drawing figures show two such elements, and they are formed as a pair of flaps on the sheath 50. As can be seen in FIG. 1, the two flexible elements 6 are disposed on opposite sides of the vibration head 4. The flexible elements 6 are anchored at the vibration head's base end 14, and extend to flexible element free ends 6A. When configured as a flap, each flexible element 6 may have a width dimension and a thickness dimension that is substantially smaller than the width dimension. The relatively small thickness dimension will render the flexible elements substantially bendable while the relatively large width dimension will allow vibrations to be delivered to a relatively wide area of the human body. In the illustrated embodiment, the thickness dimension is on the order of 0.125 inches, whereas the width dimension at the widest part of the flexible elements is on the order of 1.0-1.5 inches. Thus, in this embodiment, the flexible element width dimension is at least approximately eight times the thickness dimension. The width of the flexible elements 6 need not be constant. As can be seen in FIG. 2, the sides of the flexible elements 6 may flare outwardly from their point of attachment to the vibrator body 18 to a point of maximum width, then gradually taper toward the free ends 6A. The width dimension of each flexible element 6 in FIG. 2 is at least as wide as the corresponding width of the vibration head 4, such that the vibration head will be hidden from view behind the flexible elements when the vibrator 2 is viewed from either side. The widest part of the flexible elements in FIG. 2 is approximately the same width as the widest portion of the base 8. As can be seen in FIG. 1, the overall resulting appearance presented by the flexible elements and the vibration head 2 is that of a partially open flower, with the vibration head 4 resembling a pistil and the flexible elements 6 resembling petals. Other flexible element geometries may also be used, depending on the size of the additional areas to be vibrated.

Figure 6A:
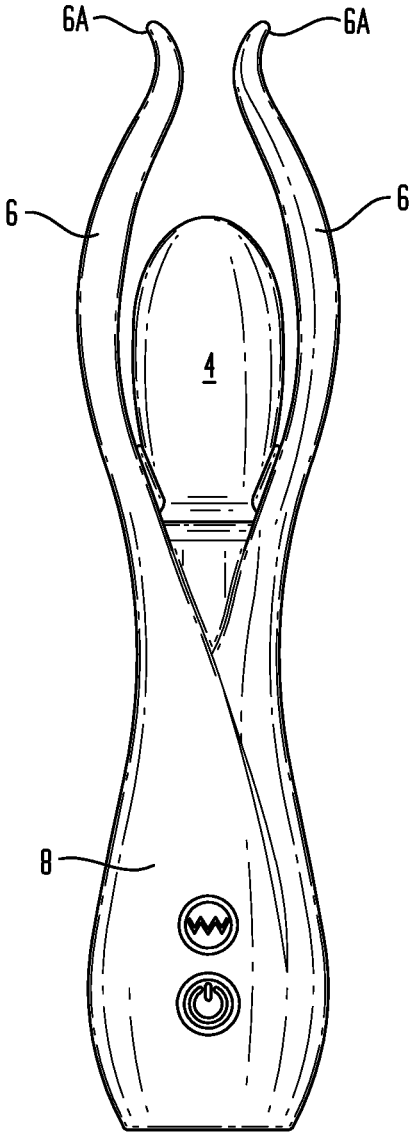
FIG. 6A is a front elevation view of the example vibrator embodiment of FIG. 1, in a home configuration.
Figure 6B:
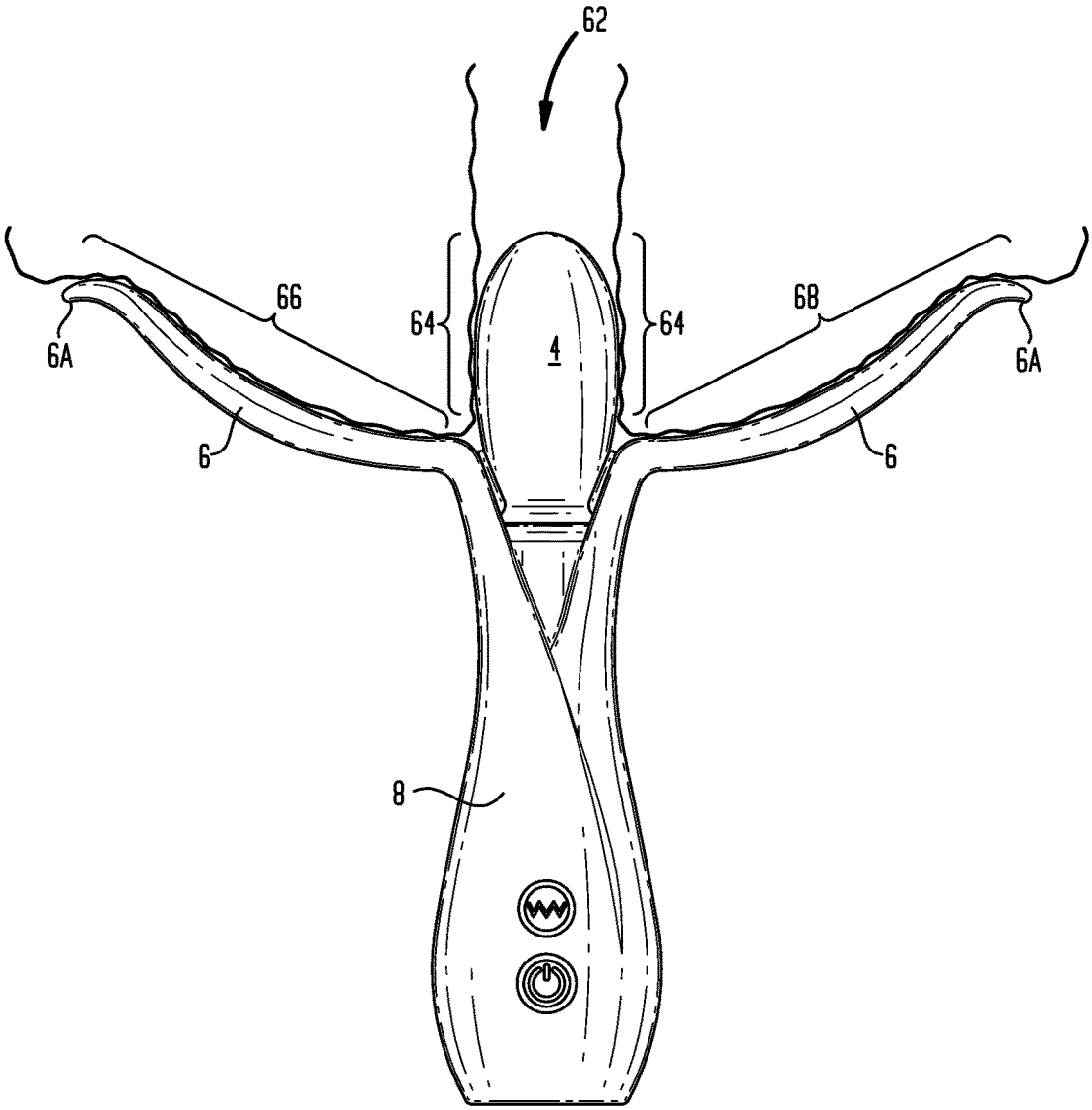
FIG. 6B is a front elevation view of the example vibrator embodiment of FIG. 1, in a spread configuration.

Turning now to FIGS. 6A and 6B, the flexible elements 6 are bendable between a closed home position wherein they are closely adjacent to the vibration head 4 (FIG. 6A), and an open spread position wherein the flexible elements are displaced away from the vibration head (FIG. 6B). As can be seen in FIG. 6A, when the flexible elements 6 are in their home position, they closely follow the contour of the vibration head 4 along its length. In the illustrated embodiment, the vibration head 4 has a bulbous shape with bulging (convex) curved sides and a rounded tip. The flexible elements 6 follow this contour, first extending outwardly from their point of attachment on the vibrator body 18, then curving back inwardly, such that each flexible element has a convex outside curvature and a concave inside curvature. This facilitates contacting engagement with most surfaces of the human body, which tend to be rounded with convex curvature. As can be seen in FIG. 6A, the flexible element free ends 6A may be curved outwardly, such that the flexible elements have a tongue-like shape. As described in more detail below, this facilitates spreading of the flexible elements when the vibrator 2 is maneuvered into position for use. In the illustrated embodiment, the free ends 6A of the flexible elements 6 are located well beyond beyond the free end 16 of the vibration head 4 (see FIG. 1). Each flexible element 6 in this embodiment is at least approximately 1.5-2 times the length of the vibration head 4. This increases the size of the additional areas to be vibrated because substantially the entire length of each flexible element 6 will deliver vibrations to the body surfaces that it contacts. Longer or shorter lengths could also be used, depending on the size of the additional areas to be vibrated. Also, each flexible element 6 could be different in length than the other flexible element(s).

Although the flexible elements 6 are shown as being slightly spaced from the vibration head 4 when in the home position, they could also be in contact with the sides of the vibration head 4 for a portion of their length. In the spread position, the flexible elements become relatively widely displaced away from the vibration head 4, depending on the contour of the body areas that they engage. For example, in FIG. 6B, the flexible elements 6 are bent nearly 90 degrees from their home position. In other embodiments, the flexible elements could be flexible enough to bend further, perhaps until they touch the base 8 of the vibrator body 18. This would constitute a bending range of approximately 180 degrees from the home position to the spread position.

During use of the vibrator 2, the vibration motor 22 imparts vibrations to the vibration head 4 so that the latter can be used to deliver vibrations to a desired first region of a human body. This region will typically (but not always) be an orifice or cavity that can accommodate the length of the vibration head, such as the female genitalia for example. This usage is shown in FIG. 6B, wherein the vibration head 4 is disposed in an orifice 62. The sides of the orifice 62 represent a first body region 64 that receives vibrations from the vibration head 4. The vibration motor 22 also imparts vibrations to the flexible elements 6, which, as previously mentioned, are formed as a pair of flaps on opposite sides of the vibration head 4 in the illustrated embodiment. The two flexible elements 6 are thus operable to deliver vibrations to two additional areas on two sides of the first body region 64 that is vibrated by the vibration head 4. These additional areas are shown in FIG. 6B by reference numbers 66 and 68. Each additional area 66/68 extends for substantially the entire length of the flexible element 6 that is contacts.

As can be seen in FIG. 6B, the flexible elements 6 are sufficiently compliant to conform to the contour of the additional areas 66/68, and lie in substantially contacting engagement against surfaces thereof. The vibrator 2 is thereby operable to deliver distributed vibrations over a diffuse area of the human body. In the example usage scenario shown in FIG. 6B, this diffuse area includes the body region 64 contacted by the vibration head 4, together with the additional areas 66 and 68 on each side thereof.

The vibrator 2 may thus be used to implement a method for delivering distributed vibrations over a diffuse area of the human body. According to the method, the vibrator head 4 is inserted into an orifice (or other body portion) that represents a primary region of the body to be vibrated. Depending on the length of the flexible elements 6, and also their home position spacing, the flexible element free ends 6A will initiate contact with two additional areas that are adjacent to the primary region as the vibration head 4 is advanced toward and into the orifice. As previously mentioned, the free ends 6A of the flexible elements 6 may be curved outwardly. This curvature will induce outward bending of the flexible elements 6 as soon as the free ends 6A make contact with the body. Advancing the vibration head 4 further toward, then into, the orifice (or other body portion), will continue to spread the flexible elements 6 due to the increasing surface contact that occurs between each flexible element and the additional area 66 or 68 that it engages. During the insertion procedure, the flexible elements 6 will thus bend from their home position, as exemplified by FIG. 6A to their spread position, as exemplified by FIG. 6B. Once the flexible elements 6 are in the spread position, the vibrator will be operable to deliver distributed vibrations to the diffuse area to be stimulated.

Accordingly, a vibrator suitable for delivering distributed vibrations over a diffuse area of the human body has been disclosed. Although various embodiments have been described, it should be apparent that many variations and alternative embodiments could be implemented. It is understood, therefore, that the invention is not to be in any way limited except in accordance with the spirit of the appended claims and their equivalents.

What is claimed is:

1. A vibrator, comprising:

a vibration head operable to deliver vibrations to a first region of a human body;

two or more flexible elements disposed on two or more sides of said vibration head, said two or more flexible elements being operable to deliver vibrations to two or more additional body areas on two or more sides of said first body region, said two or more flexible elements being sufficiently compliant over substantially their entire length to conform to a contour of said two or more additional areas and lie in substantially contacting engagement against surfaces thereof along substantially the entire length of each flexible element;

said two or more flexible elements each comprising a flap whose thickness is everywhere substantially less than its width so as to provide said compliant capability;

said two or more flexible elements being bendable starting from a base end thereof between a closed home position and an open spread position;

said two or more flexible elements extending beyond a free end of said vibration head when in said home position; and whereby said vibrator is operable to deliver distributed vibrations over a diffuse area of said human body that includes said first region and said two or more additional areas.

2. The vibrator of claim 1, wherein said flaps are disposed on opposite sides of said vibration head.

3. The vibrator of claim 1, wherein said two or more flexible elements are part of a flexible rubber sheath that covers said vibration head.

4. The vibrator of claim 1, wherein said two or more flexible elements are anchored at a base end of said vibration head.

5. The vibrator of claim 1, wherein said two or more flexible elements are bendable starting from a base end thereof between said closed home position being wherein said two or more flexible elements are adjacent to said vibration head, and said open spread position being wherein said two or more flexible elements are displaced away from said vibration head.

6. The vibrator of claim 5, wherein said two or more flexible elements are closely adjacent to said vibration head when in said home position.

7. The vibrator of claim 5, wherein said two or more flexible elements are constructed to bend 90-180 degrees from said home position to said spread position.

8. The vibrator of claim 1, wherein said width is at least eight times said thickness.

9. A vibrator, comprising:

a vibration head operable to deliver vibrations to a first region of a human body;

a pair of flexible flaps whose thickness is everywhere substantially smaller than their width;

said flexible flaps being disposed on opposite sides of said vibration head, said flaps being operable to deliver vibrations to two additional areas on both sides of said first body region, said flaps by virtue of said thickness being everywhere substantially smaller than said width being sufficiently compliant over substantially their entire length to conform to a contour of said two additional areas and lie in substantially contacting engagement against surfaces thereof along substantially the entire length of each flexible element;

said flaps extending beyond said vibration head when in a non-flexed home position; and whereby said vibrator is operable to deliver distributed vibrations over a diffuse area of said human body that includes said first body region and said two additional areas.

10. The vibrator of claim 9, further including:

a base attached to a base end of said vibration head, said base and said vibration head defining an elongated vibrator body in which said base and said vibration head respectively provide first and second vibrator body end portions; and a vibration motor in said vibrator body, said vibration motor being operable to impart vibrations to said vibration head and said flexible flaps.

11. The vibrator of claim 10, wherein said flaps are anchored to said vibrator body proximate to an intersection of said vibration head and said base.

12. The vibrator of claim 9, wherein said flaps are closely adjacent to said vibration head when in a non-flexed home position.

13. The vibrator of claim 9, wherein said flaps are bendable 90-180 degrees from a non-flexed home position to a spread position.

14. The vibrator of claim 9, wherein said width is at least eight times said thickness.

15. The vibrator of claim 9, wherein said flaps have a tongue shape with free ends that diverge from each other to facilitate spreading said flaps when they are brought into contact with said additional areas of said human body.

16. A method for delivering distributed vibrations over a diffuse area of the human body, comprising:

providing a vibrator, said vibrator comprising:

a vibration head operable to deliver vibrations to a first region of a human body;

two or more flexible elements disposed on two or more sides of said vibration head, said two or more flexible elements being operable to deliver vibrations to two or more additional areas on two or more sides of said first body region, said two or more flexible elements being sufficiently compliant over their entire length to conform to a contour of said two or more additional areas and lie in substantially contacting engagement against surfaces thereof along substantially the entire length of each flexible element;

said two or more flexible elements each comprising a flap whose thickness is everywhere substantially smaller than its width so as to provide said compliant capability;

said two or more flexible elements being bendable starting from a base end thereof between a closed home position and an open spread position;

said two or more flexible elements extending beyond a free end of said vibration head when in said home position; and whereby said vibrator is operable to deliver distributed vibrations over a diffuse area of said human body that includes said first body region and said two or more additional areas;

said method comprising:

inserting said vibration head into an orifice representing said first body region;

contacting said two or more flexible elements against said two or more additional areas of said human body; and advancing said vibration head into said orifice to spread said two or more flexible elements due to increasing surface contact occurring between said two or more flexible elements and said two or more additional areas of said human body.

* * * * *